US006343756B1

(12) United States Patent
Weil

(10) Patent No.: US 6,343,756 B1
(45) Date of Patent: Feb. 5, 2002

(54) SHELL LINER ASSEMBLY AND POCKET INSERT FOR ORE GRINDING MILLS

(75) Inventor: James A. Weil, Plymouth, MN (US)

(73) Assignee: ME International, Inc, Minneapolis, MN (US)

( * ) Notice: Subject to any disclaimer, the term of this patent is extended or adjusted under 35 U.S.C. 154(b) by 0 days.

(21) Appl. No.: 09/452,680

(22) Filed: Dec. 1, 1999

(51) Int. Cl.[7] ..... B02C 17/22
(52) U.S. Cl. ..... 241/299; 241/DIG. 30
(58) Field of Search ..... 241/DIG. 30, 182, 241/183, 299, 300

(56) References Cited

U.S. PATENT DOCUMENTS 1,315,025 A * 9/1919 Lawler ..... 241/183
1,921,672 A * 8/1933 Haushalter ..... 241/183
4,052,014 A * 10/1977 Jonsson ..... 341/183
4,165,041 A 8/1979 Larsen
4,402,465 A * 9/1983 Persson et al. ..... 241/183

* cited by examiner

*Primary Examiner*—Mark Rosenbaum
(74) *Attorney, Agent, or Firm*—Merchant & Gould

(57) ABSTRACT

A liner assembly for the shell or drum of an ore grinding machine is disclosed with an insert used to facilitate its removal. The liner assembly comprises a plurality of liner segments mounted in side-by-side relation, with adjacent liner segments defining a pocket therebetween of generally triangular configuration. A wedge-shaped insert is disposed within each pocket to reduce the amount of particulate matter entering the pocket and to protect the inner surface of the shell. The wedge-shaped insert is formed from resilient material and includes a recess or groove taking the form of an inverted V extending upwardly from its bottom surface. The recess enables the insert to internally collapse if the pocket is of lesser cross-sectional dimension than that of the insert.

12 Claims, 2 Drawing Sheets

SHELL LINER ASSEMBLY AND POCKET INSERT FOR ORE GRINDING MILLS

The invention is generally related to apparatus for comminuting ore, and is specifically directed to an improved liner assembly for an ore grinding mill used in commercial mining operations and an insert used in conjunction with the liner assembly to facilitate removal of worn liner segments. The invention represents an improvement of the invention disclosed in commonly owned U.S. Pat. No. 4,165,041, which issued Aug. 21, 1979.

Ore grinding mills typically consist of a large cylindrical drum which is rotated about a horizontal axis. The axial ends of the drum are open, and the material to be comminuted is continuously fed into the mill at one end with the comminuted product continuously emerging from the other end.

Many ores such as taconite (iron ore) are extremely hard and highly abrasive. In order to maintain continuous operation of the grinding mill, it is necessary to provide a wear liner for the drum which is highly abrasion-resistant, and which also is tough enough to withstand the continuous impact of ore fragments. Grinding mills of this type may also employ rods or balls to assist in the comminuting process, which further compounds the problem of wear.

Abrasion-resistant liners are necessarily segmented (i.e., constructed from a plurality of components) for a number of reasons, including the limited size of narrow access openings and the significant size and weight of the liner taken as a whole. Current ore comminuting mills reach diameters of 40 feet. The wear liner is therefore typically constructed from a plurality of wear segments which may be aligned both axially and circumferentially on the inner surface of the mill shell and/or ends.

The individual liner segments of conventional liner assemblies are mounted in spaced relation so that gaps exist between each segment and the adjacent segment or segments. This is done for several reasons, one of which is that there must be a degree of tolerance to accommodate the various segments. It would be possible to construct a liner assembly from a plurality of segments the dimensions of which are machined to close tolerances, but this is not economically feasible for the relatively large wear segments which are typically formed from pearlitic or martensitic steel, or white iron.

The problem created by having gaps between adjacent segments is that the particulate material resulting from the comminution process becomes lodged in the gaps and causes the wear segments to stick together. This problem is more acute with mills having ball media because balls tend to fragment with increased wear, and these particles also enter and become lodged in the gaps. Peening of the segments likewise increases with usage, also forcing the individual segments together. The combined effect of particulate material forced between the gaps and segment peening results in the liner assembly becoming integral (i.e., the segments become interconnected), which increases the difficulty of removing the individual liner segments when replacement is necessary. Often, removal of the segments takes considerably more time than installation, resulting in substantial down time of the mill. This has serious economic effects, since many ore processing plants operate 24 hours a day.

The invention of U.S. Pat. No. 4,165,041 offered a solution to this problem by configuring each liner segment to have tapered longitudinal sides and ends, with the taper creating an undercut with the liner segment mounted on the cylindrical shell. As configured, the adjacent wear segments disclosed in the patent define a pocket therebetween which is generally triangular in cross-section and extends either the length and/or the width of the wear segments.

The invention of U.S. Pat. No. 4,165,041 further comprised a wedge or triangularly shaped insert placed into each pocket, where it is loosely retained. The length of the insert corresponds in length to the segment length or width, depending on the application. The use of inserts in the triangular pockets in effect prevents particulate matter from entering the pockets, thus preventing the buildup of material which makes segment removal difficult.

This invention represents an improvement to the insert of U.S. Pat. No. 4,165,041, and specifically addresses a problem sometimes encountered when the sides and/or ends of the liner segment leave an undersized pocket relative to the size of the insert. As indicated above, it is not economically feasible for steel or iron to be cast in close tolerance for wear segments of this type, and if the gaps between adjacent liner segments are undersized (i.e., the liner segments are oversized), the inserts may have the effect of preventing the liner segments from seating properly, or it is difficult if not impossible to place the inserts in the liner assembly.

It has been found that this problem can be overcome by forming a recess or groove in the bottom surface of the insert which, in the preferred embodiment, is a V-groove that corresponds to the configuration of the insert itself. In essence, this results in an insert having two diverging legs which can collapse together to the degree required if the pocket between liner segments is undersized.

The preferred embodiment of the improved insert is also formed with a leg that projects upwardly from the generally triangular body having a length that is sufficient to project above at least a portion of the adjacent liner segments. This facilitates proper placement of the insert at the time the liner assembly is installed.

The invention will be more fully appreciated from the drawings and specification.

A BRIEF DESCRIPTION OF THE DRAWINGS

A DESCRIPTION OF THE PREFERRED EMBODIMENT

Figure 1:
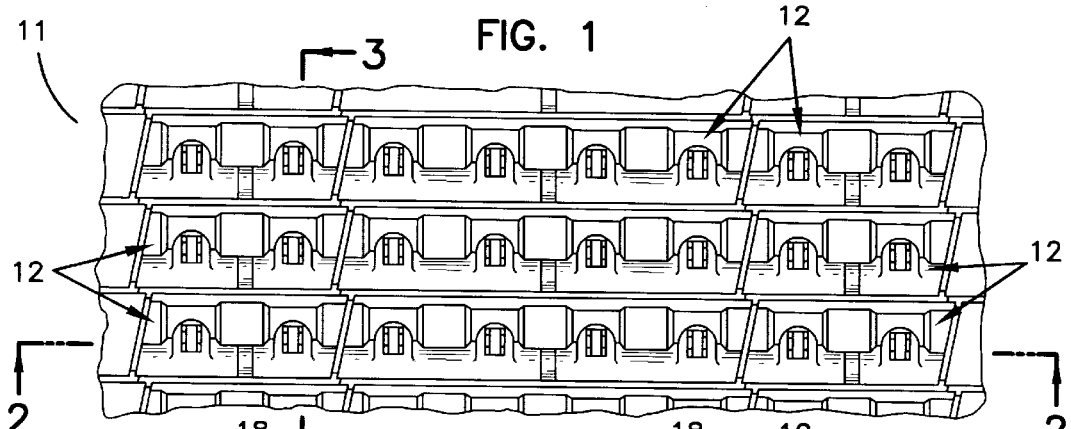
FIG. 1 is a fragmentary view showing a segmented liner assembly for an ore grinding mill according to the invention and viewed radially outward from within the mill.
Figure 2:
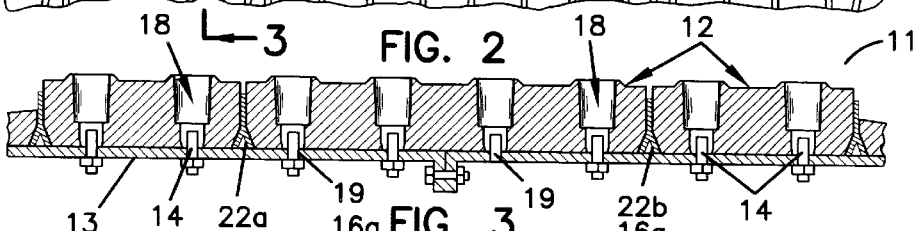
FIG. 2 is a fragmentary sectional view taken along the line 2—2 of FIG. 1.
Figure 3:
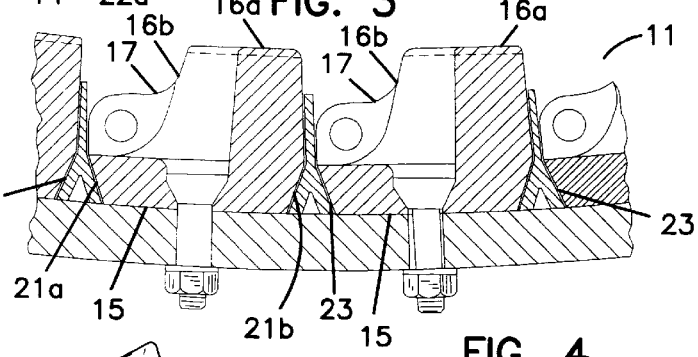
FIG. 3 is an enlarged fragmentary sectional view taken along the line 3—3 of FIG. 1.

With initial reference to FIGS. 1–3, a liner assembly is represented generally by the numeral 11. Liner assembly 11 comprises a plurality of individual liner segments 12 which are secured to a cylindrical drum or shell 13 and cover virtually the entirety of its inner cylindrical surface. As shown in FIG. 1, the segments 12 are arranged in longitudinal rows which are disposed in alignment with the rotational axis of the drum. In the preferred assembly, the liner segments 12 also define circumferential rows.

Figure 4:
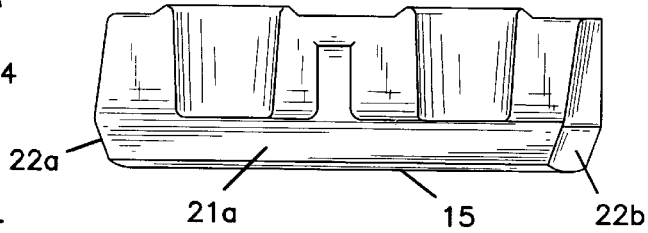
FIG. 4 is a view in side elevation of one of the individual segments, showing with particularity the tapered configuration of the segment sides and ends.

With reference to FIGS. 3 and 4, each of the liner segments 12 has a mounting surface 15 which is slightly curved to conform to the inner cylindrical surface of drum 13, such curvature being exaggerated in FIG. 4 for purposes of clarity.

Each of the liner segments 12 is also formed with an inner grinding surface of irregular contour, defining an elevated tumbling ridge 16*a* and a lower convex surface 16*b* (FIG. 3). A centrally disposed lifting hook 17 projects from the convex surface 16*b*. The overall configuration of the liner grinding surface is thus undulated, defined by alternating, axially extending ridges and valleys, which together increase the effectiveness of the tumbling and ore grinding process as the drum 13 rotates.

As shown in FIGS. 1 and 2, the liner segments 12 are of two lengths, and each is formed with two or four mounting openings 19 which are registrable with corresponding mounting openings 19 in the drum 13 to receive nut and bolt assemblies 14. Reference is made to U.S. Pat. No. 4,018,393 for details of the structure and cooperative function of the nut and bolt assemblies 14 with the mounting sockets 18 and mounting openings 19, which do not constitute a part of this invention.

In the preferred embodiment, each of the segment bodies 12 is trapezoidal in shape, being formed with oblique, parallel ends.

The segment bodies 12 ultimately become worn during the ore comminuting process and require replacement. As indicated above, a problem arises from material entering the cracks between the segment body sides and ends. Coupled with media impact peening of the segment bodies, the liner assembly ultimately becomes integral; i.e., the segment bodies are effectively joined together and as such resist removal.

Figure 5:
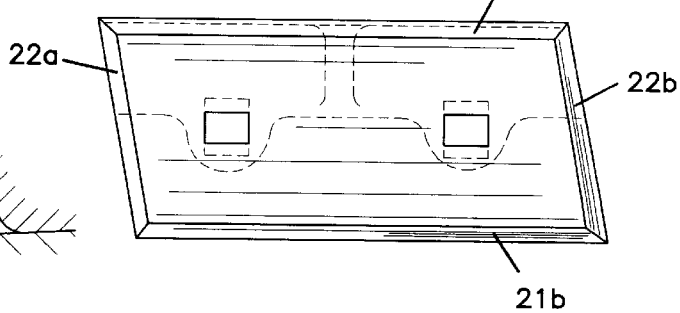
FIG. 5 is a view in bottom plan of the segment body, also showing the tapered configuration of the sides and ends.

Each of the segment bodies 12 is relieved along each longitudinal side and end to define tapered side surfaces 21*a*, 21*b*, and tapered end surfaces 22*a*, 22*b* (see particularly FIG. 5). As constructed, the opposed tapered surfaces 21*a*, 21*b* and 22*a*, 22*b* converge toward the mounting surface 15. Accordingly, the cross-sectional dimension of each segment body 12 decreases as the mounting surface 15 is approached. The angle of taper of each of these surfaces may, for example, be on the order of 20°.

Figure 6:
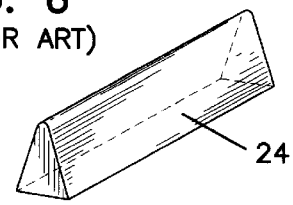
FIG. 6 (PRIOR ART)
FIG. 6 is a perspective view of a prior art wedge-shaped insert disposable between adjacent segment sides and/or segment ends in the assembled liner assembly.

As shown in FIGS. 2 and 3, the opposed tapered side surfaces and end surfaces of adjacent body segments 12 define longitudinal, triangular pockets 23. In U.S. Pat. No. 4,165,041, wedge-shaped inserts 24 (see FIGS. 6 and 7) are placed in each of the pockets 23 as the individual segment bodies 12 are bolted into place. As disclosed in the patent, the inserts 24 generally correspond in size and shape to the pockets 23, and have a length corresponding essentially (but not limited) to the length of the segment body 12, or to its width, depending on the application.

Figure 7:
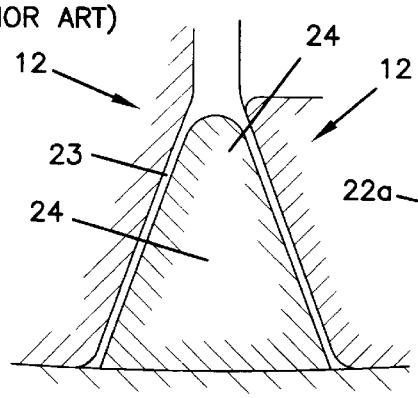
FIG. 7 (PRIOR ART)
FIG. 7 is an enlarged transverse sectional view of the prior art wedge-shaped insert, showing in particular its relation to adjacent segment bodies in the mill liner surface.

The prior art insert 24 is shown in relation to the liner segments 12 in FIG. 7. Preferably, the transverse cross-sectional size of the insert 24 is slightly less than the associated triangular pocket 23 so that the insert 24 is loosely retained within the pocket 24. This ensures that the insert 24 can be properly inserted into the pocket 23. However, if the pocket 23 is undersized for any reason, as for example, by out-of-tolerance castings or liner segment mounting that is shifted slightly, it is difficult either to insert the insert 24 into the undersized pocket 23 or to mount an adjacent liner segment 12 with the insert 24 in place.

Figure 8:
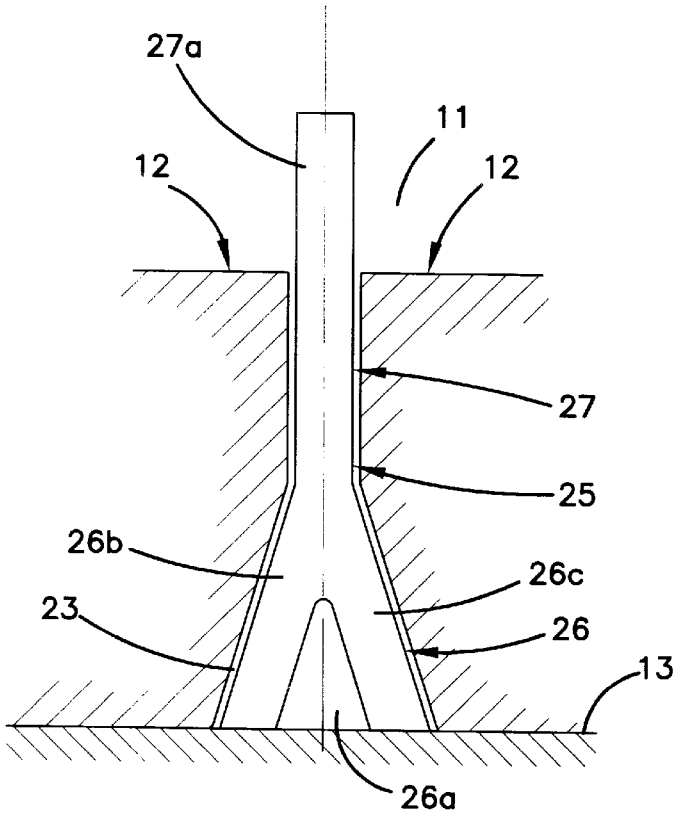
FIG. 8 is an enlarged transverse sectional view of the inventive insert positioned between adjacent liner segments of normal tolerance.
Figure 9:
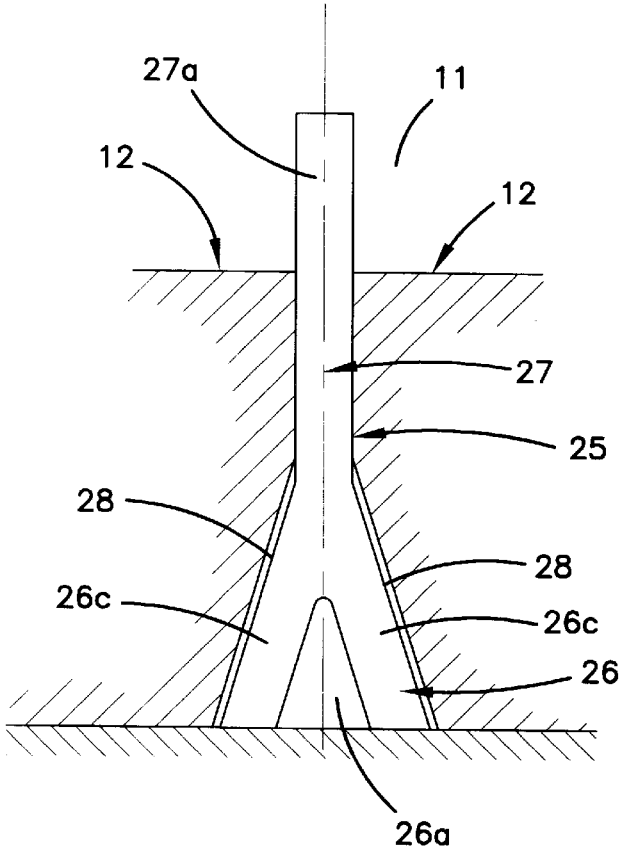
FIG. 9 is a view similar to FIG. 8, with the inventive insert disposed between liner segments sized and/or mounted to define an undersized pocket therebetween.

This problem has been overcome with an improved insert 25, which is shown in FIGS. 1–3, 8, and 9. As best shown in FIGS. 8 and 9, the improved insert 25 defines a lower portion 26 and upper portion 27. Lower portion 26 is similar to prior art insert 24, the external surface of which is wedge-shaped. However, lower portion 26 is formed with a recess 26*a* extending upwardly from its lower surface, which, in the preferred embodiment, is itself triangular in configuration. As a result, diverging leg members 26*b*, 26*c* are formed.

The insert 25 is preferably formed from a resilient material such as rubber. As such, the leg members 26*b*, 26*c* are capable of collapsing inward in the presence of external forces; e.g., adjacent liner segments 12 that define an undersized pocket 23.

The upper portion 27 of insert 25 defines an upright leg member 27*a*, the height of which may be chosen commensurate with the application. As shown in FIGS. 8 and 9, the vertical leg member 27*a* may project above the top surface of the liner segments 12, although this is not an essential feature of the invention.

FIG. 8 discloses the insert 25 between adjacent liner segments 12 that are properly toleranced and correctly mounted on the mill drum 13, and as such define an appropriately sized pocket 23. Under these circumstances, insert 25 is loosely retained between the liner segments. It nevertheless precludes the entry of any substantial amount of material between the segment bodies 12, and offers protection to the inner cylindrical surface of drum 13.

In FIG. 9, the liner segments 12 are either mounted too closely together or they are beyond dimensional tolerance. In either case, the gap or pocket 23 is undersized, as represented by the additional material shown at 28. If the prior art insert 24 were used, it would either be very difficult to force its entry into the gap 23 or, if inserted prior to mounting of one of the liner segments 12, the segment would not seat properly. However, by virtue of the recess 26*a*, leg members 26*b*, 26*c* are able to collapse toward each other, thus providing the requisite clearance for insert 25.

In the position shown in either FIG. 8 or FIG. 9, insert 25 prevents the entry of particulate matter between the adjacent segment liners 12, and in so doing, protects the drum 13 and also facilitates removal of the liner segments 12 when they are worn and require replacement. In this regard, the draft or inclination of the sides of pocket 23 and legs 26*b*, 26*c* enable each liner segment to be quickly and easily lifted out of place after the nut and bolt assemblies 14 have been removed.

What is claimed:

1. A removable liner assembly for the shell of an ore grinding machine, comprising:

a plurality of liner segments, each of which comprises a segment body defining a mounting surface constructed for mounting engagement with a shell surface and a grinding surface for comminuting the ore, each segment body defining opposite sides configured to define a pocket when assembled in side-by-side relation with another segment body;

means for connecting each liner segment to the shell of the ore grinding machine; and insert means disposed in each of said pockets for reducing the amount of particulate matter entering said pocket and protecting the inner surface of the shell, each insert means being configured and sized to substantially fill the pocket between adjacent segment bodies, and each insert means comprising recess means disposed to permit the insert means to internally collapse in the presence of external forces and thereby conform to an undersized pocket.

2. The liner assembly defined by claim 1, wherein the insert means has a length generally corresponding to but not limited to the length of the associated pocket.

3. The liner assembly defined by claim 2, wherein each of said opposite sides is tapered, defining a generally triangular pocket, and the insert means are wedge-shaped.

4. The liner assembly defined by claim 3, wherein the insert means has tapered sides and a generally flat bottom, the recess means extending upwardly from said bottom.

5. The liner assembly defined by claim 4, wherein said recess means comprises an inverted V-groove.

6. The liner assembly defined by claim 5, which further comprises a leg member that projects upwardly from the convergence of said tapered sides.

7. The liner assembly defined by claim 1, wherein each segment body defines opposed, parallel longitudinal sides and ends, each of which at least in part tapers toward said mounting surface.

8. The liner assembly defined by claim 1, wherein the insert means comprises an elongated member having a cross-section generally corresponding to said pocket.

9. The liner assembly defined by claim 8, wherein each segment body defines opposed, parallel longitudinal sides and ends, that at least in part taper toward said mounting surface, the liner segments being assembled in rows to define pockets between adjacent tapered longitudinal sides and adjacent ends, with insert means disposed in each of said pockets.

10. The liner assembly defined by claim 9, wherein the tapered surfaces are flat, defining a triangularly shaped pocket, and the insert means are wedge-shaped.

11. The liner assembly defined by claim 1, wherein the liner segments are assembled in rows to define pockets between adjacent tapered longitudinal sides and adjacent ends, and insert means are disposed in each of said pockets.

12. The liner assembly defined by claim 11, wherein each insert means has a length generally corresponding to but not limited to the length of the associated pocket.

* * * * *